US005931461A

United States Patent [19]

Xu

[11] Patent Number: 5,931,461

[45] Date of Patent: Aug. 3, 1999

[54] PAPER SHEET RECEPTACLE HAVING TRANSVERSELY ELASTICALLY SUPPORTED BARRIER WALL PLATE

[75] Inventor: Weihua Xu, Ibaraki-ken, Japan

[73] Assignee: Riso Kagaku Corporation, Tokyo, Japan

[21] Appl. No.: 08/774,376

[22] Filed: Dec. 27, 1996

[30] Foreign Application Priority Data

Jan. 5, 1996 [JP] Japan ..... 8-017192

[51] Int. Cl.[6] ..... B65H 31/20

[52] U.S. Cl. ..... 271/224; 271/182

[58] Field of Search ..... 271/220, 222, 271/224, 182; 414/788.9

[56] References Cited

U.S. PATENT DOCUMENTS

| | | | |
|---|---|---|---|
| 3,907,128 | 9/1975 | Cathers . | |
| 4,380,332 | 4/1983 | Davis | 271/224 X |
| 4,385,758 | 5/1983 | Ellsworth | 271/224 |

FOREIGN PATENT DOCUMENTS

| | | | |
|---|---|---|---|
| 2151083 | 4/1973 | Germany | 271/224 |
| A-28 48 513 | 5/1979 | Germany . | |
| 58-31856 | 2/1983 | Japan | 271/224 |
| U-62-186854 | 11/1987 | Japan . | |
| A-63-134466 | 6/1988 | Japan . | |
| A-63-143172 | 6/1988 | Japan . | |
| U-2-91747 | 7/1990 | Japan . | |
| U-5-1755 | 1/1993 | Japan . | |
| A-7-137420 | 5/1995 | Japan . | |
| A-7-137916 | 5/1995 | Japan . | |

*Primary Examiner*—Boris Milef
*Attorney, Agent, or Firm*—Oliff & Berridge, PLC

[57] ABSTRACT

The barrier wall device for paper sheets flying thereto with one edge posing as a front edge as discharged from a printing portion of a copying or printing machine to collide there-against is constructed to have a barrier wall plate elastically supported from a frame body by an elastic tensile support device extending perpendicularly to the direction of fly coming of the paper sheets, so that the barrier wall plate is biased in parallelism by expanding and inclining the tensile support device. The paper sheet receptacle is desirably adaptable to a high speed copying or printing machine so that paper sheet collision noise is lowered, with paper sheets received to form a well trued stack.

3 Claims, 5 Drawing Sheets

PAPER SHEET RECEPTACLE HAVING TRANSVERSELY ELASTICALLY SUPPORTED BARRIER WALL PLATE

BACKGROUND OF THE INVENTION

1. Field of the Invention

The present invention relates to the art of copying and printing machines, and more particularly, to a paper sheet receptacle for receiving paper sheets discharged from a printing portion of a copying or printing machine in a stacked up state.

2. Description of the Prior Art

A copying or printing machine is generally provided with a paper sheet receptacle having a barrier wall means adapted to be collided at with a front edge of a paper sheet flying as discharged from a printing portion of a copying or printing machine with the front edge as a forward end, and a stack floor means adapted to receive the paper sheet collided at and falling along the barrier wall means from below thereof, so that, when a plurality of paper sheets are successively discharged, they are successively stacked up in the paper sheet receptacle to form a stacked up body of the paper sheets.

According to the recent development of copying and printing machines for higher speed operation, the paper sheets discharged from the printing portion of those machines fly at high speed toward the paper sheet receptacle with each one edge thereof posing a forward end, colliding at the barrier wall means of the paper sheet receptacle with a large momentum. In this case, if the barrier wall means has a rigid construction, a large collide sound is generated, and further the paper sheet is sprung back for a large distance by the reaction applied by the barrier wall means. Since the spring-back distance is much affected even by a small difference in the flying posture of each paper sheet as magnified by a corresponding difference of air resistance, the stacked up body of the paper sheets formed in the paper sheet receptacle shows a great disorder with scattered distances left between the front edges of the paper sheets and the wall surface of the barrier wall means.

Against such a problem the conventional counter-measure is to attach a cushion sheet means made of sponge, rubber, or the like onto the surface of the barrier wall means where the front edges of the paper sheets collide. Such a cushion sheet attached onto the front surface of the barrier wall means lowers the collide sounds of the paper sheets to certain extent when the cushion sheet is constructed with a soft material having a low modulus of elasticity. However, when the cushion sheet is made so soft as a sufficient muffling effect is available, the positioning function of the barrier wall means against the front edges of the paper sheets lowers, so that the disorder of the paper sheets stacked up in the paper sheet receptacle increases.

SUMMARY OF THE INVENTION

In view of the above-mentioned problems concerned with the paper sheet receptacles of high speed copying or printing machines, it is a principal object of the present invention to provide a paper sheet receptacle of copying or printing machines improved so as to collect the paper sheets fly coming at high speed as discharged from the printing portion of high speed copying or printing machines with each one front edge posing a forward end silently and well trued up.

According to the present invention, the above-mentioned object is accomplished by a paper sheet receptacle of a copying or printing machine comprising a barrier wall means for a paper sheet flying as discharged from a printing portion of the machine to collide thereat with a front edge thereof, and a stack floor means for receiving the paper sheet collided at and falling along said barrier wall means from below thereof, wherein said barrier wall means comprises a frame body, a barrier wall plate, and an elastic tensile support means interposed between said frame body and said barrier wall plate so as to pull said barrier wall plate toward said frame body at at least a pair of up and down or left and right edge portions thereof in an orientation substantially perpendicular to the direction of flying of the paper sheet such that said barrier wall plate biases in parallelism while expanding and inclining said tensile support means when the paper sheet collided at said barrier wall plate.

The above-mentioned tensile support means may comprise a rubber sheet or tensile coil springs connected with said frame body and said barrier wall plate by pivot means.

BRIEF DESCRIPTION OF THE DRAWINGS

In the accompanying drawings.

DESCRIPTION OF THE PREFERRED EMBODIMENTS

In the following, the invention will be described in more detail with respect to the embodiments thereof with reference to the accompanying drawings.

In order to lower the sound of collision generated at a collision of the front edge of the paper sheet at the barrier wall means, it is a matter of course that the barrier wall means should present a surface as much softer as possible against the front edge of the paper sheet. The matter that the barrier wall means presents a soft surface against the front edge of the paper sheet means that the modulus of elasticity in the elastic retreat of the wall surface due to the pressing by the front edge of the fly coming paper sheet is low. When the barrier wall plate is supported by the elastic tensile support means at at least a pair of up and down or left and right edge portions thereof as pulled by the elastic tensile support means in the orientation substantially perpendicular to the direction of fly coming of the paper sheet, such that the barrier wall plate biases in parallelism by expanding and inclining the elastic tensile support means, it is possible that the modulus of elasticity of the reaction force acting against the paper sheet at the moment of the collision of the front edge of the paper sheet at the barrier wall plate is made very low, while the distance of the temporary retreat of the barrier wall plate due to the kinetic energy of the fly come paper sheet is made very small and highly stabilized, so that the truing up of the front edges of the stacked up paper sheets by the barrier wall means is accomplished silently at high precision.

Figure 1:
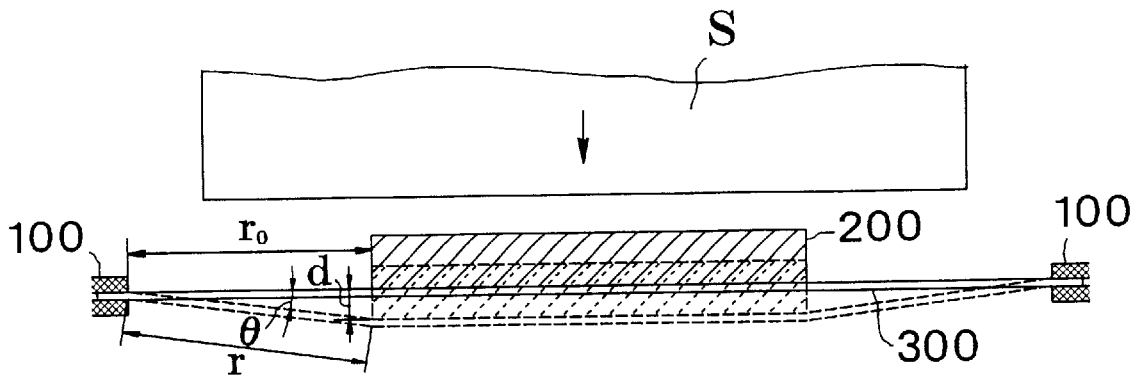
FIG. 1 is an illustration of the operation of the barrier wall means according to the invention.

In more detail, referring to FIG. 1 of the accompanying drawings, it is to be understood that 100, 200 and 300 are the frame body, the barrier wall plate and the tensile support means of the paper sheet receptacle, respectively. The tensile support means is a membrane of a rubber material having a relatively low modulus of elasticity, firmly mounted to the frame body 100 at a pair of side edge portions thereof. It is desirable that the barrier wall plate is a light-weighted plate member having a soft surface to contact with the paper sheet. The barrier wall plate biases in parallelism as a whole as depicted by broken lines in the figure when it is pushed by the front edge of a paper sheet S fly come as shown by an arrow. In order that the barrier wall plate is pushed back by as small a force as possible to bias in parallelism as a whole due to the kinetic energy of the paper sheet, it is desirable that the mass of the barrier wall plate is as small as possible. Such a light-weighted and hard barrier wall plate is available from styrol, foamed vinyl chloride, etc. Or otherwise, for the convenience of manufacture, the barrier wall plate may be formed as an integral part of a rubber membrane in which a central portion of the membrane is made thicker than peripheral portion adapted to work as the elastic tensile support means, wherein the central portion is made thick enough to be deemed as a substantially non-expandable plate member. In this case, it is desirable that the barrier wall plate portion is given a rigidity by ribs in a lattice form or the like, a frame work of steel wires, bundle of fibers, cloth, etc. being embedded therein, so that the ratio of the modulus of elasticity to the mass of the barrier wall plate portion is increased. When the barrier wall plate 200 is constructed to have a less mass, it presents a less resistance due to its inertia against being pushed back by the paper sheet. Further, it will be more desirable that the barrier wall plate is made of a perforated material or bored with appropriate wind through openings so that the air resistance applied thereto in its retreating movement is reduced.

Expressing in FIG. 1 that a pair of opposite side edges of the barrier wall plate 200 are each distant from each of the corresponding fixed opposite side edges of the tensile support means 300 (called simply rubber membrane 300 hereinbelow for convenience) by a distance $r_o$, it is assumed that, by a substantially uniform collision of the front edge of the paper sheet S come flying from up to down as viewed in the figure, the barrier wall plate 200 biases downward in the figure in parallelism, while substantially maintaining its flat shape, with a corresponding expansion and inclination of the opposite side edge portions of the rubber membrane 300 until the barrier wall plate and the rubber membrane 300 take the position depicted by broken lines in the figure. Expressing the distance of the parallel biasing of the barrier wall plate 200 by d, the angle of inclination of the opposite side edge portions of the rubber membrane 300 by θ, and the length of the expanded and inclined portion of the rubber membrane by r, the following relationships are established:

$$d=r_0*\tan\theta$$

$$r=r_0/\cos\theta$$

When, for example, $r_0$ is 10 mm, assuming that the rubber membrane 300 does not expand at the portion thereof laid one over the other with the barrier wall plate 200 as it is adhered thereto, the value of d and the expansion of the opposite side edge portions of the rubber membrane 300, i.e. $r-r_0=\Delta r$ change against θ of 0°, 5°, 10°, 15°, 20° and 25° as shown in the following table:

| θ | tan θ | cos θ | 1/cos θ | d | Δr |
|---|---|---|---|---|---|
| 0 | 0 | 1 | 1 | 0 | 0 |
| 5 | 0.087 | 0.996 | 1.004 | 0.87 | 0.04 |
| 10 | 0.176 | 0.985 | 1.015 | 1.76 | 0.15 |
| 15 | 0.268 | 0.966 | 1.035 | 2.68 | 0.35 |
| 20 | 0.364 | 0.940 | 1.064 | 3.64 | 0.64 |
| 25 | 0.466 | 0.906 | 1.104 | 4.66 | 1.04 |

Figure 2:
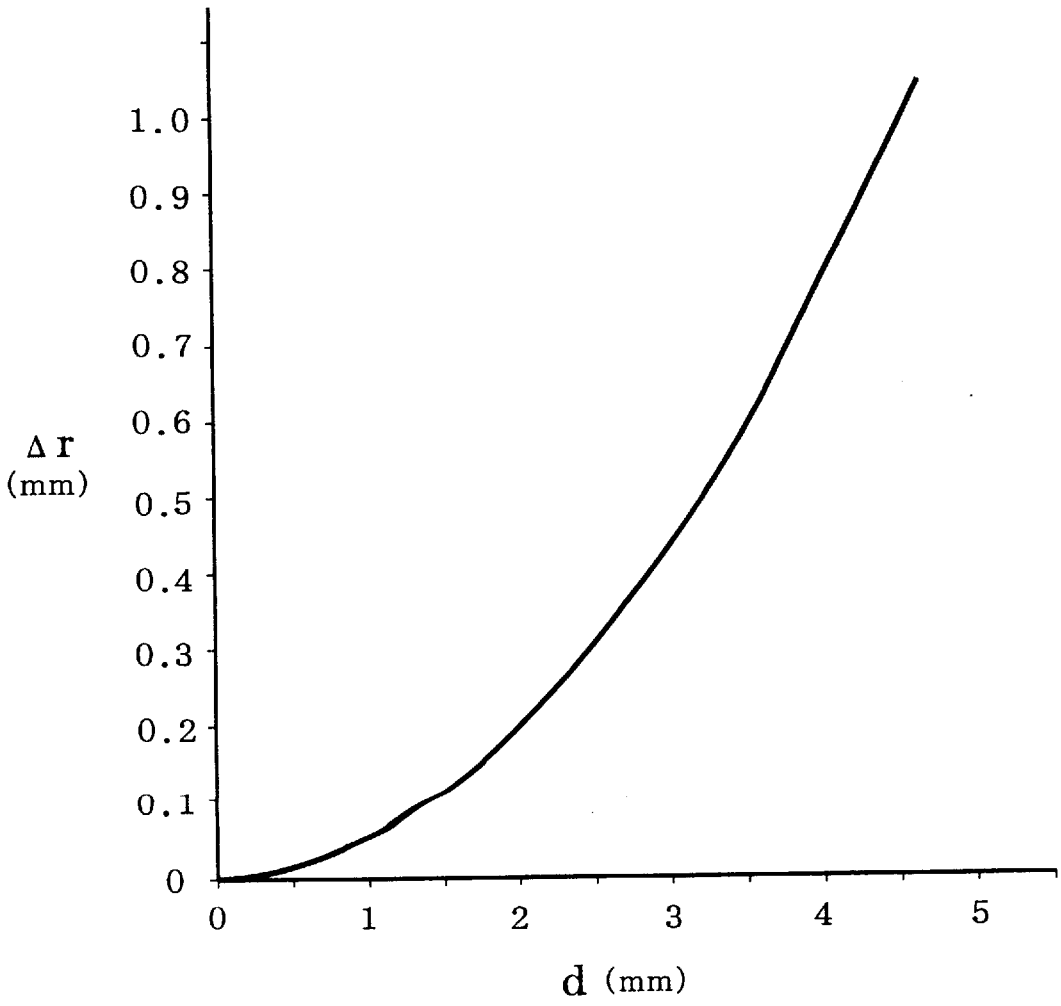
FIG. 2 is a graph showing changes of expansion of the tensile support means against a parallel biasing of the barrier wall plate in the barrier wall device shown in FIG. 1.

By plotting the figures of the table, a graph such as shown in FIG. 2 is obtained. As will be understood from the graph of FIG. 2, as the distance d increases starting from 0, in a range where d is very small near 0, the rate of increase of Δ relative to the increase of d is very low, that is, when the barrier wall plate biases in parallelism, the rubber membrane is not substantially expanded, such that the ratio of the elastic resistance applied by the opposite side edge portions of the rubber membrane 300 to the barrier wall plate against its biasing to the amount of the biasing, i.e. an apparent modulus of elasticity of the barrier wall means against the biasing thereof, remains in a very small value close to 0. This means that at the instant when the front edge of the paper sheet S collides at the barrier wall plate 200 and in a minute period succeeding thereto during which there is a probability of generating a sound of collision, the barrier wall plate is very soft against the paper sheet. Therefore, when the total mass of the barrier wall plate 200 and substantially the part of the rubber membrane 300 laid over the barrier wall plate is made small enough against the momentum of the paper sheet S at the time of collision (mass times velocity), the impact force at the collision of the paper sheet S to the barrier wall plate 200 is made very low, such that the sound of collision can be suppressed near 0. Once the front edge of the paper sheet S has contacted the surface of the barrier wall plate 200, even how the elastic reaction which the assembly of the barrier wall plate 200 and the rubber membrane 300 presents against the forward movement of the paper sheet increases, the sound of collision is no longer generated.

Further, as will be understood from the graph of FIG. 2, Ar increases rapidly along with increase of d, so that the elastic reaction which the assembly of the barrier wall plate 200 and the rubber membrane 300 presents against the further forward movement of the paper sheet S under the expansion and inclination of the opposite side edge portions of the rubber membrane 300 increases rapidly along with the further forward movement of the paper sheet S. Therefore, in an example such as shown above where the value of $r_0$ is 10 mm, when the front edge of the paper sheet proceeds only 3 mm from the position of the instant of collision at the barrier wall plate 200, the reaction force increases to about 10 times of that which acts at a position proceeded about 1 mm from the position of the instant of collision.

Thus, according to the construction of the present invention, a barrier wall means is available such that it is very soft at the instant of collision of the front edge of the paper sheet thereto and in a minute period subsequent thereto, while rapidly hardening thereafter, so that even when there is a substantial dispersion in the fly coming speed and/or the posture of respective paper sheets at the instant of collision to the barrier wall means, the finally biasing distance of the barrier wall means is very small and the difference in the finally biasing distance for the respective paper sheets remains very small, such that the positions of the respective paper sheets received in the paper sheets receptacle after the dissipation of the kinetic energy thereof change little against one another, providing a well trued up stack of paper sheets.

Figure 3:
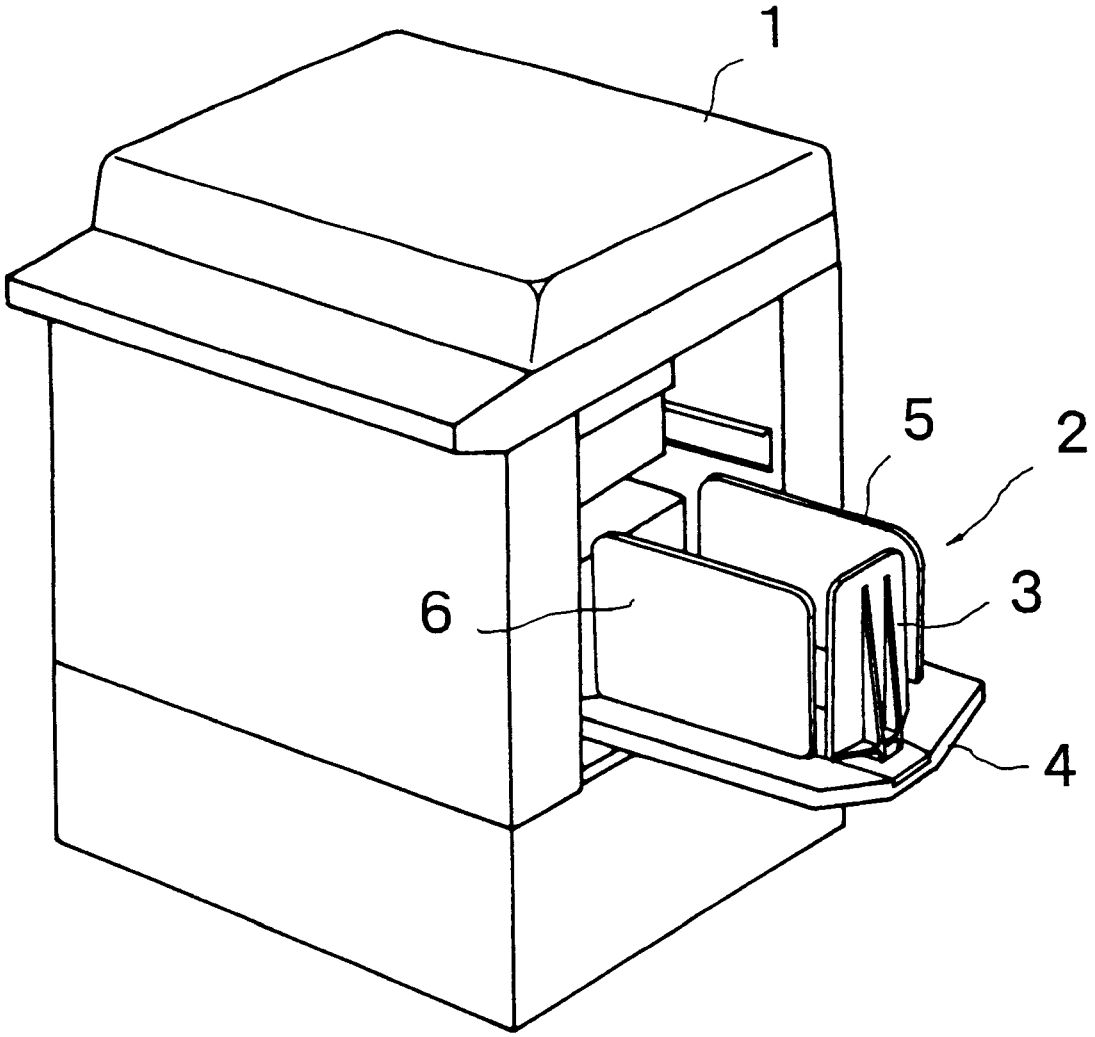
FIG. 3 an outside perspective view of an example of a copying-printing machine equipped with the paper sheet receptacle to which the invention is applicable.

FIG. 3 is a perspective view showing an embodiment of a printing machine equipped with the paper sheet receptacle according to the present invention. The printing machine herein shown is manufactured and sold by the applicant, by which a stencil sheet is perforated according to an original and a stencil printing is carried out by using the perforated stencil sheet. It will be apparent that the paper sheet receptable according to the invention may be assembled in a copying machine in the same manner. The inside constructions of such a printing machine is already known in various embodiments by patent and utility model publications including those filed by the same assignee as the present application. A relatively new model of such a machine is shown in Japanese Patent Laid-open Publication 7-137420 based upon Japanese Patent Application 5-306031 filed by the same assignee as the present application. Since the present invention does not relate to the constructions of the copying and printing portions at the inside of the body 1 of such a copying-printing machine but relates to the paper sheet receptacle 2 for collecting print sheets flying thereto with one edge thereof posing as the front edge as discharged from the printing portion thereof, particularly the barrier wall means 3, the detailed descriptions about the constructions at the inside of the body 1 of the copying-printing machine will be omitted.

As exemplarily shown in FIG. 3, the paper sheet receptacle 2 of this kind comprises, as a general construction, a barrier wall means 3 for the paper sheet flying thereto as discharged from the printing portion in the body 1 with one edge thereof posing as the front edge to collide thereagainst, and a stack floor means 4 for receiving the print sheet colliding at and descending along the barrier wall means from under thereof, with the barrier wall means 3 being mounted to the stack floor means 3 so as to be adjustable of the position thereof with respect to the stack floor means along the direction of discharge of the paper sheet. An invention with regard to a device for making such an adjustment of the barrier wall means is shown in Japanese Patent Application 5-306037 (Japanese Patent Laid-open Publication 7-137916) filed by the same assignee as the present application. Further, such a paper sheet receptacle is, in most cases, equipped with side wall means 5 and 6 for truing opposite side edges of the paper sheets stacked up in the paper sheet receptacle, as shown in FIG. 1.

Figure 4:
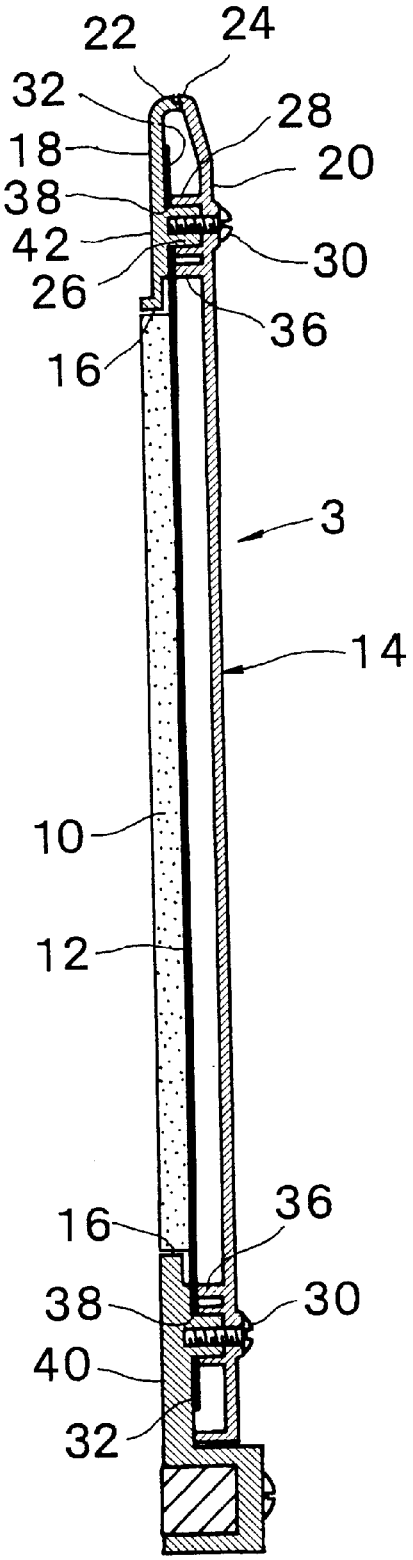
FIG. 4 a longitudinally sectional view showing an embodiment of the barrier wall device according to the invention.
Figure 5:
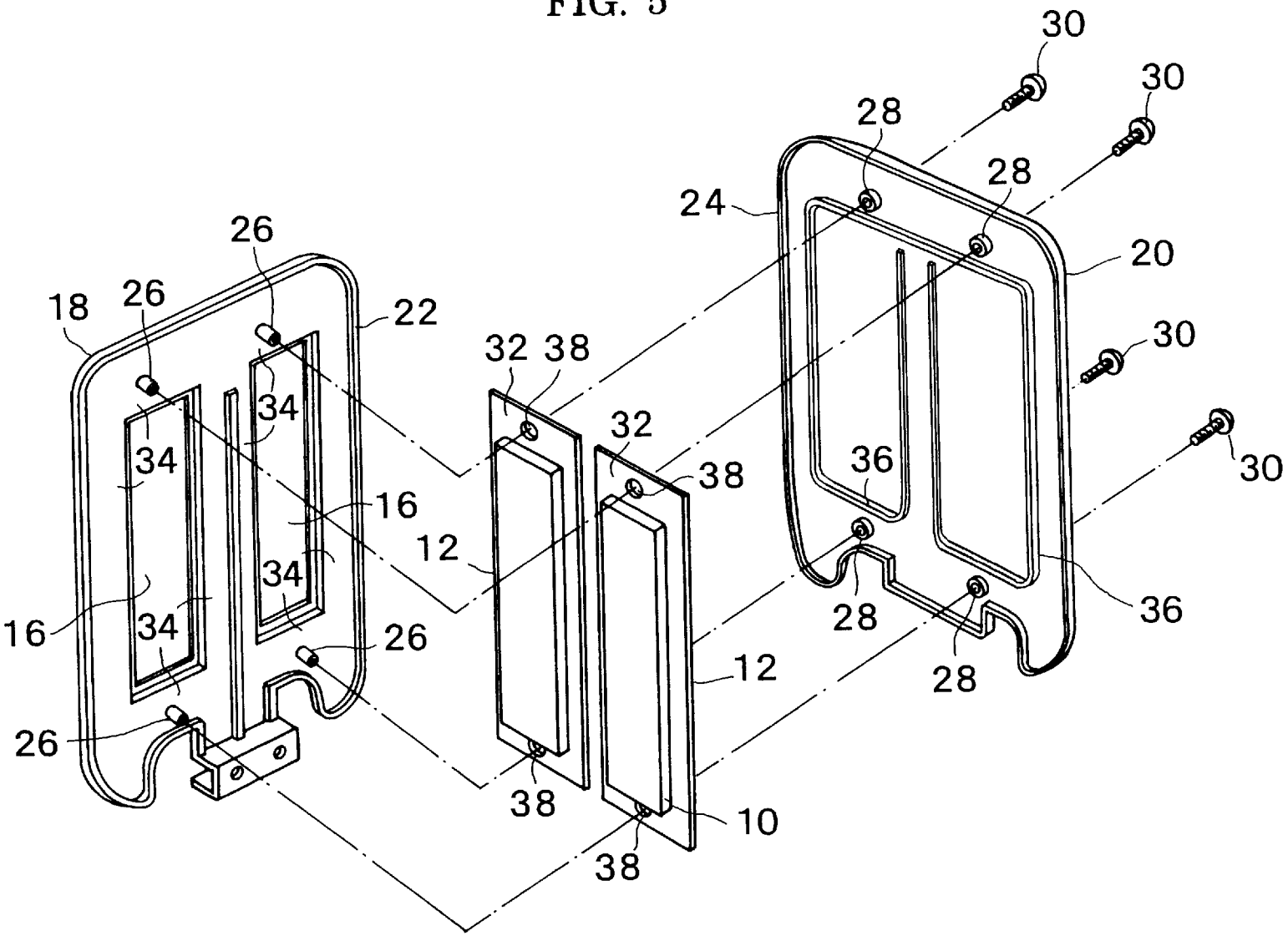
FIG. 5 an exploded perspective view of the barrier wall device shown in FIG. 4.

FIG. 4 is a longitudinally sectional view of an embodiment of the barrier wall means constructing an essential portion of the present invention, and FIG. 5 is an exploded perspective view thereof. The barrier wall means of this construction may be mounted to the stack floor means 4 in a manner disclosed in the specification and the drawing of the above-mentioned Japanese Patent Application 5-306037 (Japanese Patent Laid-open Publication 7-137916) so as to be adjustable with respect to the position thereof in the direction of discharge of the print sheet. Since the construction for mounting the barrier wall means to the stack floor means is not an essential portion of the present invention, illustration and descriptions of the details of such a mounting construction will be omitted for the brevity of the specification and the drawing.

In these figures, the barrier wall means generally designated by reference numeral 3 comprises a barrier wall plate 10 of a rectangular outer contour having a surface facing toward the fly coming direction of the paper sheet to let the front edge thereof collide thereagainst. The barrier wall plate 10 is elastically supported by an elastic membrane 12 having a rectangular outer contour and adhered at the rear face thereof to a central portion of the elastic membrane. The rectangular outer contour of the elastic membrane 12 is made larger than the rectangular outer contour of the barrier wall plate 10 so that an annular edge area is left along the four edges of the barrier wall plate, the annular edge area being mounted to a frame body 14 at a peripheral portion thereof as described in detail hereinbelow. The barrier wall plate 10, elastic membrane 12 and frame body 14 correspond to the barrier wall plate 200, rubber membrane 300 and frame body 100 of FIG. 1, respectively.

The frame body 14 has a construction of assembly made of a first frame member 18 providing a front annular edge portion of the barrier wall means with two openings 16 for receiving two barrier wall plates 10, and a second frame member 20 having an annular edge portion to meet with the annular edge portion of the first frame member 18 and adapted to cover the rear faces of the two barrier wall plates. In more detail, the frame member 18 constructing the front face of the barrier wall means and the frame member 20 constructing the rear face of the barrier wall means are abutted to one another in alignment such that a fringing portion 22 formed along the outer periphery of the frame member 18 meets with a fringing portion 24 formed along the outer periphery of the frame body 20, except a portion extending along the lower end thereof, with four pins 26 formed in the frame body 18 engaging the corresponding tubular pin receiving holes 28 formed in the frame body 20, so that the assembly of the two frame members is readily accomplished in alignment. The pin receiving holes 28 are each a cupshaped projection provided on the inside of the frame member 20 as viewed from the inner side of the assembly, with a through opening being formed at a central portion of the bottom of the cup. The pin 26 of the frame member 18 is formed with a threaded bore, so that the frame members 18 and 20 are laid one over the other with the four pins 26 engaged in the corresponding pin receiving holes 28, while sandwiching the elastic membrane 12 therebetween and clamping it together by four pieces of screws being screwed into the threaded bore of the pins 26 from the outer side of the frame member 20 through the bottom opening of the cut-shaped pin receiving holes 28, thereby immediately providing a complete firm barrier wall construction assembled of the opposite frame members.

The elastic membrane 12*s* are disposed relative to the frame member 18 such that the barrier wall plates 10 attached thereto are each passed through each of the openings 16, while the annular edge portions 32 thereof are in contact with an annular edge portion 34 of the frame member 18 around the openings 16 as pressed thereagainst by a rectangular annular rib 36 provided at the inside of the frame member 20, so that each of the barrier wall plates 10 is firmly supported at the annular peripheral edge thereof by the elastic membrane 12, when the frame members 18 and 20 are clamped together by the screws 30. The elastic membrane 12 is formed with openings 38 in its upper and lower edge portions to let the pins 26 pass therethrough, so that, as will be understood from FIG. 4, the two elastic membranes 12 can be assembled to the frame body 18 at the predetermined position thereof by the engagement of the pins 26 into the openings 38 before the frame members 18 and 20 are clamped together by clamping the upper and lower edge portions of the elastic membranes 12 between the edge portions 34 and the ribs 36.

For further detail, as will be understood from FIG. 4, the surface of the barrier wall 10 for contacting with the front edge of the paper sheet is so shaped as to smoothly continue to a face 40 which the frame body 18 presents along a lower edge thereof, so that the print sheet collided at the barrier wall plate at the front edge thereof descends with the front edge thereof moving along the surface of the barrier wall plate 10 and further along the surface 40 of the frame member 18 when the height of the stack of print sheets is still low. The front surface of the frame member 18 may be disposed to incline slightly backward so that the front surface 40 of the lower end thereof is in the same plane as a surface 42 of an upper edge portion thereof.

Figure 6:
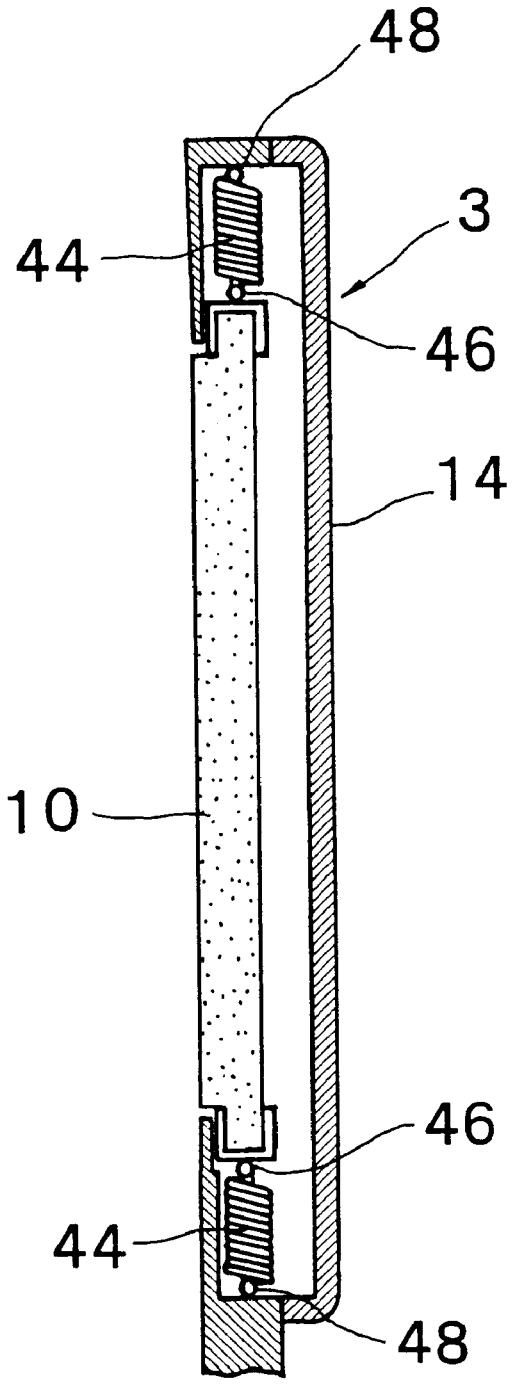
FIG. 6 is a longitudinally sectional view showing another embodiment of the barrier wall means according to the invention.

FIG. 6 is a longitudinally sectional view showing another embodiment of the barrier wall means constructing an essential portion of the paper sheet receptacle according to the present invention in a somewhat diagrammatic fashion. In this embodiment, the barrier wall plate 10 is elastically supported at upper and lower ends thereof by tensile coil springs 44. The connecting portion between the barrier wall plate 10 and the tensile coil springs 44 and the connecting portion between the tensile coil springs 44 and the frame body 14 incorporate pivot means 46 and 48, respectively, so that the tensile coil springs 46 can lightly incline for a parallel movement of the barrier wall plate 10 in the direction of thickness thereof.

Although the present invention has been described with respect to some embodiments thereof, it will be apparent for those skilled in the art that other similar embodiments are possible within the technical concepts of the present invention.

I claim:

1. A paper sheet receptacle of a machine having a printing portion comprising a barrier wall device for a paper sheet flying as discharged from the printing portion of the machine to collide thereat with a front edge thereof, and a stack floor device for receiving the paper sheet collided at and falling along said barrier wall device from below thereof, wherein said barrier wall device comprises a frame body, a barrier wall plate, and an elastic tensile support interposed between said frame body and said barrier wall plate so as to pull said barrier wall plate toward said frame body at at least a pair of up and down or left and right edge portions thereof in an orientation substantially perpendicular to the direction of flying of the paper sheet such that said barrier wall plate biases in parallelism while expanding and inclining said tensile support when the paper sheet collides with said barrier wall plate.

2. A paper sheet receptacle according to claim 1, wherein said tensile support comprises a rubber sheet.

3. A paper sheet receptacle according to claim 1, wherein said tensile support comprises tensile coil springs connected with said frame body and said barrier wall plate by pivotal connectors.

* * * * *